US011535920B2

(12) United States Patent
Hwang et al.

(10) Patent No.: US 11,535,920 B2
(45) Date of Patent: Dec. 27, 2022

(54) METHOD OF PRODUCING COPPER ALLOY SHEET MATERIAL WITH EXCELLENT STRENGTH AND CONDUCTIVITY AND COPPER ALLOY SHEET MATERIAL PRODUCED THEREFROM

(71) Applicant: POONGSAN CORPORATION, Pyeongtaek-Si (KR)

(72) Inventors: Jiin Hwang, Ulsan (KR); Youngchul Choi, Ulsan (KR); Jeongmin Cha, Ulsan (KR); Jangho Ju, Ulsan (KR)

(73) Assignee: POONGSAN CORPORATION, Pyeongtaek-Si (KR)

( * ) Notice: Subject to any disclaimer, the term of this patent is extended or adjusted under 35 U.S.C. 154(b) by 281 days.

(21) Appl. No.: 16/954,916

(22) PCT Filed: Feb. 25, 2020

(86) PCT No.: PCT/KR2020/002654
§ 371 (c)(1),
(2) Date: Jun. 17, 2020

(87) PCT Pub. No.: WO2021/020683
PCT Pub. Date: Feb. 4, 2021

(65) Prior Publication Data

US 2022/0136089 A1 May 5, 2022

(30) Foreign Application Priority Data

Jul. 26, 2019 (KR) ..... 10-2019-0090805

(51) Int. Cl.

| | |
|---|---|
| ***C22F 1/08*** | (2006.01) |
| ***B21B 1/26*** | (2006.01) |
| ***C22C 9/06*** | (2006.01) |

(52) U.S. Cl.
CPC ..... *C22F 1/08* (2013.01); *B21B 1/26* (2013.01); *C22C 9/06* (2013.01)

(58) Field of Classification Search
None
See application file for complete search history.

(56) References Cited

U.S. PATENT DOCUMENTS

2013/0087255 A1* 4/2013 Kuwagaki ..... C22C 9/01 148/435

FOREIGN PATENT DOCUMENTS

| | | | |
|---|---|---|---|
| CN | 101245422 | A | 8/2008 |
| CN | 101871059 | A | 10/2010 |
| CN | 102197151 | A | 9/2011 |
| CN | 102227510 | A | 10/2011 |

(Continued)

OTHER PUBLICATIONS

English language machine translation of JP-2007270286-A. Generated Aug. 10, 2022. (Year: 2022).*

(Continued)

*Primary Examiner* — Brian D Walck
(74) *Attorney, Agent, or Firm* — Loeb & Loeb LLP

(57) ABSTRACT

Disclosed is a method of producing a copper alloy sheet material, wherein the copper alloy sheet material contains nickel (Ni) 0.5 to 1.5% by weight; cobalt (Co) 0.3 to 1.5% by weight; silicon (Si) 0.35 to 0.8% by weight; chromium (Cr) 0.05 to 0.5% by weight; a balance amount of copper (Cu); and inevitable impurities. Further, disclosed is a copper alloy sheet material produced using the method.

9 Claims, 4 Drawing Sheets

(56) References Cited

FOREIGN PATENT DOCUMENTS

| | | | | | |
|---|---|---|---|---|---|
| CN | 102575320 | A | | 7/2012 | |
| CN | 106011534 | A | | 10/2016 | |
| CN | 108193080 | A | * | 6/2018 | ..... C22C 1/03 |
| CN | 108823466 | A | * | 11/2018 | ..... C22C 1/03 |
| JP | 2005532477 | A | | 10/2005 | |
| JP | 2007270286 | A | * | 10/2007 | |
| JP | 2009242890 | A | | 10/2009 | |
| JP | 2010275622 | A | | 12/2010 | |
| JP | 2011017072 | A | | 1/2011 | |
| JP | 2011084764 | A | | 4/2011 | |
| JP | 2011214088 | A | | 10/2011 | |
| JP | 2017179567 | A | | 10/2017 | |
| JP | 2017179568 | A | | 10/2017 | |
| JP | 2018159103 | A | | 10/2018 | |
| KR | 1020030097656 | A | | 12/2003 | |
| KR | 1020170113409 | A | | 10/2017 | |
| KR | 102021442 | B1 | | 9/2019 | |
| WO | 2011068135 | A1 | | 6/2011 | |

OTHER PUBLICATIONS

English language machine translation of CN-108193080-A. Generated Aug. 10, 2022. (Year: 2022).*

English language machine translation of CN-108823466-A. Generated Aug. 10, 2022. (Year: 2022).*

Korean Intellectual Property Office, Notice of Allowance, dated Aug. 26, 2019, 3 pages.

Translation of Office Action to corresponding Japanese Application No. 2020-528037, dated Nov. 19, 2021.

* cited by examiner

【FIG. 1】
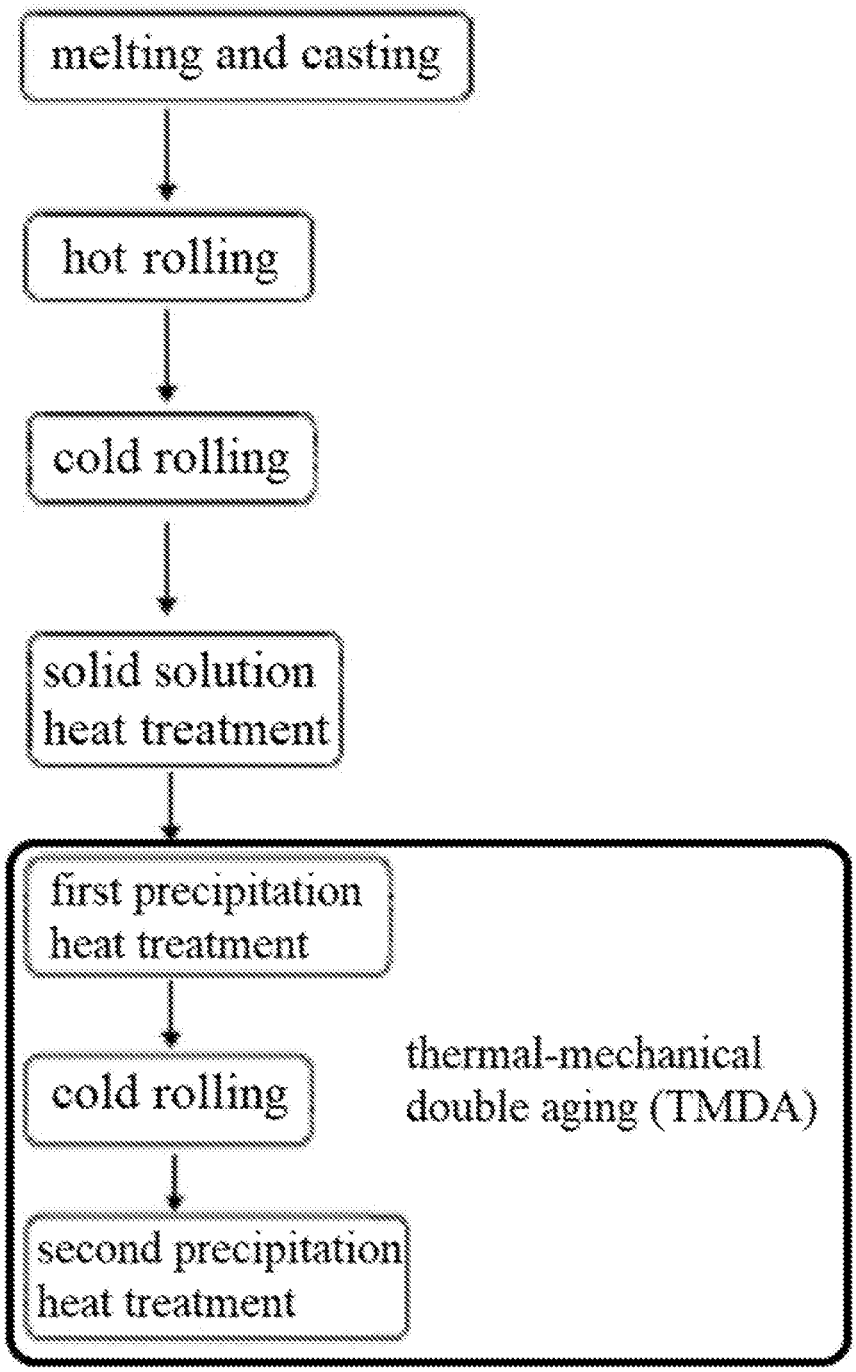

【FIG. 2】
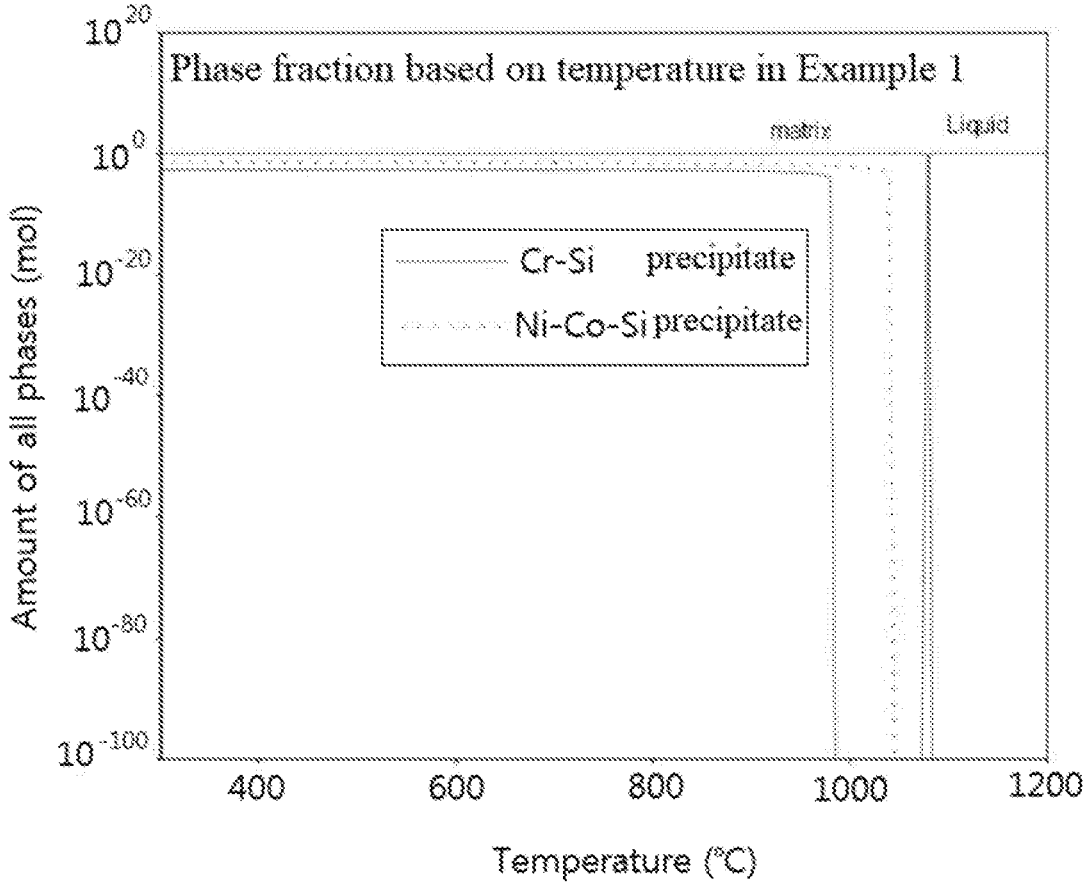

【FIG. 3】
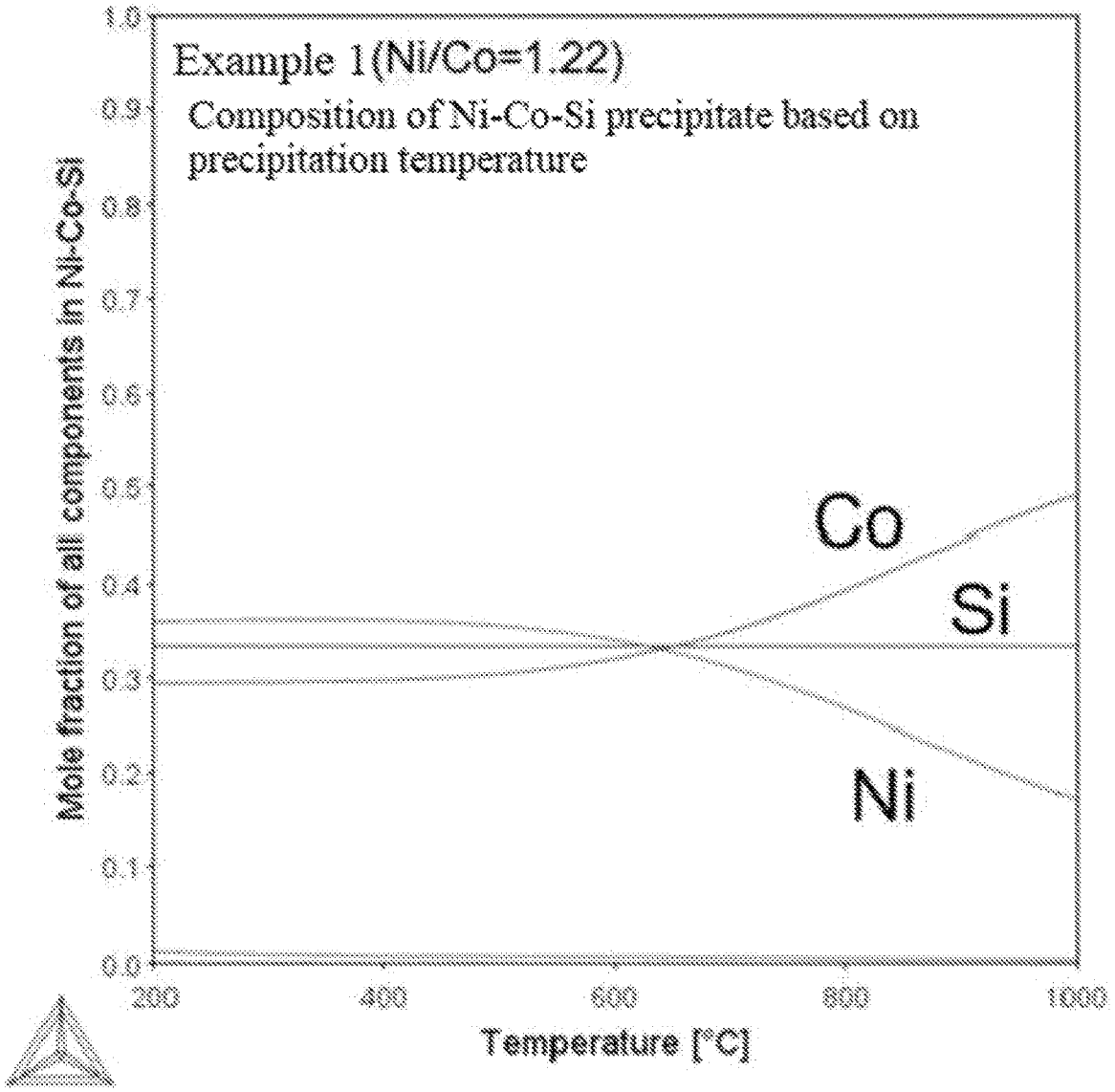

【FIG. 4】
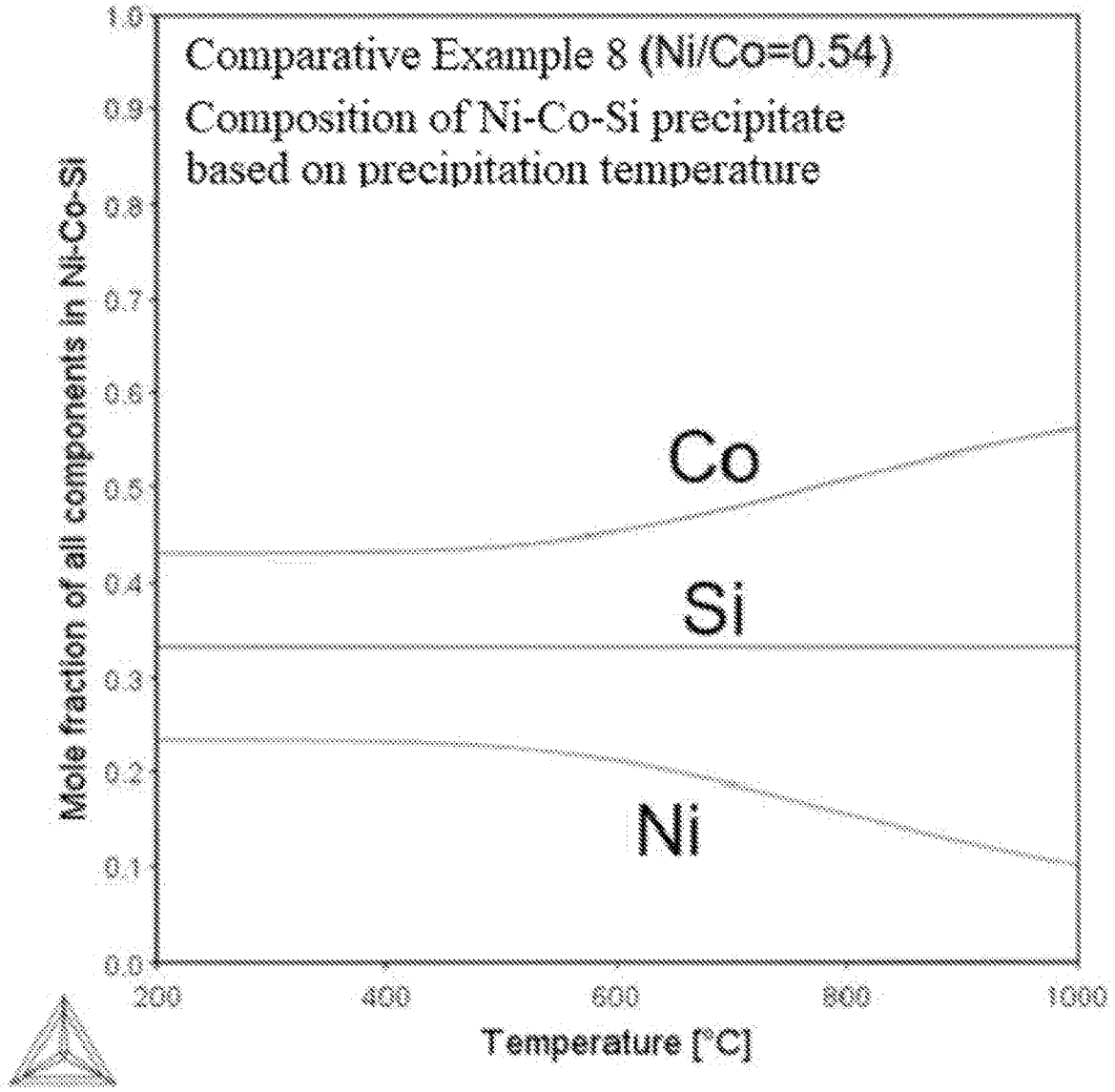

METHOD OF PRODUCING COPPER ALLOY SHEET MATERIAL WITH EXCELLENT STRENGTH AND CONDUCTIVITY AND COPPER ALLOY SHEET MATERIAL PRODUCED THEREFROM

CROSS REFERENCE OF RELATED APPLICATIONS

The present application is a US national stage of a PCT international application, Serial no. PCT/KR2020/002654, filed on Feb. 25, 2020, which claims the priority of Korean patent application No. 10-2019-0090805, filed with KIPO of Republic of Korea on Jul. 26, 2019, the entire content of these applications are incorporated into the present application by reference herein.

TECHNICAL FIELD

The present disclosure relates to a method of producing a copper alloy sheet material having excellent strength, conductivity and bending formability, and a copper alloy sheet material produced therefrom.

BACKGROUND ART

Recently, components (electronic components) constituting electronic devices have been gradually downsized and refined. Accordingly, characteristics required for a sheet material used for the components are diversified. Characteristics required for a connector among the electronic components are strength, conductivity, bending formability, etc. Copper is mainly used as a material that satisfies these characteristics. However, pure copper has low strength. Thus, various types of copper alloys containing one or greater elements to increase the strength are advantageously used.

Hardening methods commonly used to increase strength of alloys including the copper alloy include solid solution hardening, work hardening, and precipitation hardening, etc. The solid solution hardening allows an alloy element to be formed solid solution in a matrix to lower purity of a matrix to rapidly decrease conductivity. The work hardening tends to increase density of dislocations in the matrix to decrease the conductivity. The precipitation hardening may increase the purity of the matrix via the nucleation and growth mechanism of precipitates and at the same time effectively contribute to hardening. As a typical precipitation hardened copper alloy, a copper (Cu)-nickel (Ni)-silicon (Si)-based (so-called, Corson-based) alloy has excellent bending formability and thus is often used for a component with high workability such as a connector.

However, in recent years, as the electronic component has been further miniaturized, thinning of the copper alloy sheet material has been demanded. In order to overcome increase in electrical resistance and decrease in load carrying capacity due to the thinning, it is necessary to improve strength and conductivity. Further, in order to improve the strength, an amount of nickel (Ni) should be increased. However, when the nickel addition amount exceeds 2.6% by weight, it is difficult to avoid formation of coarse particles having a precipitate size exceeding 3 μm. Since the coarse particles act as a crack initiator during bending and deteriorate the bending formability, it is difficult to achieve both of the required properties of the strength and the bending formability at the same time in the existing Colson-based alloy.

Conventionally, in order to solve this problem, a method is proposed in which cobalt (Co) or chromium (Cr) is added alone or in combination to the Colson-based alloy, and then, solid solution heat treatment is executed, and, then, one or two times additional heat treatments are carried out, and then a last cold rolling is performed, thereby improving strength and conductivity of the alloy.

Specifically, Japanese Patent No. 6385383 intends to improve properties by adding nickel (Ni), silicon (Si), cobalt (Co), and chromium (Cr) in a copper alloy sheet material. However, this approach may not simultaneously achieve conductivity of 55.0% IACS or higher, and strength of 720 MPa or higher as 0.2% proof stress.

Further, Japanese Patent No. 5647703 discloses that a total content of nickel (Ni) and cobalt (Co) exceeded 3.0% by mass, and the 0.2% proof stress exhibits excellent strength of 980 MPa or greater. However, formation of coarse particles having a size exceeding 3 μm is not completely suppressed, and thus the bending formability is deteriorated. Further, there is a limit that conductivity of an obtained copper alloy sheet material could not reach 45% IACS.

Further, in the above documents, a process mechanism for facilitating cobalt (Co) precipitation during the production process has not been clearly identified. Further, after performing long-term or multiple precipitation heat treatments, finish rolling is performed. Thus, solid solubility of the alloy element in the copper matrix is rapidly reduced, and thus there is a limit in achieving both of high strength and excellent conductivity at the same time in the finish rolling.

DISCLOSURE

Technical Problem

A purpose of the present disclosure is to provide a method of producing a copper (Cu)-nickel (Ni)-cobalt (Co)-silicon (Si)-chromium (Cr) alloy sheet material having excellent strength and conductivity using thermal-mechanical two-stages precipitation, and to provide a copper alloy sheet material produced therefrom.

Technical Solutions

According to the present disclosure, there is proposed a method of producing a copper alloy sheet material, wherein the copper alloy sheet material contains: nickel (Ni) 0.5 to 1.5% by weight; cobalt (Co) 0.3 to 1.5% by weight; silicon (Si) 0.35 to 0.8% by weight; chromium (Cr) 0.05 to 0.5% by weight; a balance amount of copper (Cu); and inevitable impurities, wherein the method comprises: melting and casting the component elements (Ni, Co, Si, Cr, and Cu) to form an ingot; hot-rolling the ingot at 950 to 1040° C.; cooling the hot-rolled product; cold-rolling the cooled product at a cold reduction rate of 70% or higher to form a copper alloy sheet material; performing solid solution heat treatment of the sheet material at 800 to 1040° C. for 20 to 60 seconds; and performing thermal-mechanical double aging of the solid solution heat treated sheet material, wherein the thermal-mechanical double aging includes: performing first precipitation of the solid solution heat treated sheet material at 550 to 700° C. for 20 to 60 seconds; cold-rolling the first precipitated sheet material at a cold reduction rate of 10 to 50%; and performing second precipitation of the cold rolled sheet material at 300 to 550° C. for 1 to 24 hours.

A sum of contents of nickel (Ni) and cobalt (Co) meets a following relationship: $1.5 \leq Ni+Co \leq 2.6$, and a ratio between contents of nickel (Ni) and cobalt (Co) satisfies a following relationship: $0.8 \leq Ni/Co \leq 1.3$.

Contents of nickel (Ni), cobalt (Co), silicon (Si) and chromium (Cr) satisfies a following relationship: $3.5 \leq (Ni+Co)/(Si-Cr/3) \leq 4.5$.

The copper alloy sheet material further contains at least one selected from a group consisting of manganese (Mn) 0.01 to 0.2% by weight, phosphorus (P) 0.01 to 0.2% by weight, magnesium (Mg) 0.01 to 0.2% by weight, tin (Sn) 0.01 to 0.2% by weight, zinc (Zn) 0.01 to 0.5% by weight, and zirconium (Zr) 0.01 to 0.1% by weight.

According to the present disclosure, there is proposed a copper alloy sheet material produced using the method defined above, wherein the copper alloy sheet material has a microstructure containing an α mother phase and intermetallic compound precipitates, wherein the intermetallic compound precipitates has an average diameter of 3 μm or smaller.

0.2% proof stress of the copper alloy sheet material measured in a direction parallel to a rolling direction thereof is in a range of 720 MPa to 820 MPa, wherein conductivity of the copper alloy sheet material is in a range of 55% IACS to 60% IACS, wherein a 90° bending formability in a direction parallel to a rolling direction and a direction perpendicular to a rolling direction of the copper alloy sheet material is R/t=0.

Advantageous Effects

The production method of the copper alloy sheet material proposed from the present disclosure may produce the copper alloy sheet material having excellent strength and conductivity and excellent bending formability.

DESCRIPTION OF DRAWINGS

FIG. 1 is a process flow chart briefly showing a method of producing a copper alloy sheet material with excellent strength and conductivity according to the present disclosure.

FIG. 2 is a graph showing a phase fraction based on temperature in a production process of a copper alloy sheet material with the composition of Example 1.

FIG. 3 is a graph showing a molar fraction of each element of Ni—Co—Si precipitates based on change in temperature that may be applied to first and second precipitation heat treatments in a production process of a copper alloy sheet material with a composition of Example 1.

FIG. 4 is a graph showing a molar fraction of each element of Ni—Co—Si precipitates based on change in temperature that may be applied to first and second precipitation heat treatments in a production process of a copper alloy sheet material having a composition of Comparative Example 8.

BEST MODE

According to the present disclosure, there is proposed a method of producing a copper alloy sheet material, wherein the copper alloy sheet material contains the following component elements: nickel (Ni) 0.5 to 1.5% by weight; cobalt (Co) 0.3 to 1.5% by weight; silicon (Si) 0.35 to 0.8% by weight; chromium (Cr) 0.05 to 0.5% by weight; a balance amount of copper (Cu); and inevitable impurities, wherein the method comprises: melting and casting the component elements (Ni, Co, Si, Cr, and Cu) to form an ingot; hot-rolling the ingot at 950 to 1040° C.; cooling the hot-rolled product; cold-rolling the cooled product at a cold reduction rate of 70% or higher to form a copper alloy sheet material; performing solid solution heat treatment of the sheet material at 800 to 1040° C. for 20 to 60 seconds; and performing thermal-mechanical double aging of the solid solution heat treated sheet material, wherein the thermal-mechanical double aging includes: performing first precipitation of the solid solution heat treated sheet material at 550 to 700° C. for 20 to 60 seconds; cold-rolling the first precipitated sheet material at a cold reduction rate of 10 to 50%; and performing second precipitation of the cold rolled sheet material at 300 to 550° C. for 1 to 24 hours.

First, a composition range of the component elements of the copper alloy sheet material according to the present disclosure will be described in detail. In the description of the composition range of the component elements in the present disclosure, % representing a content of each component element means % by weight unless otherwise indicated.

(1) Nickel (Ni)

A content of nickel (Ni) in accordance with the present disclosure is in a range of 0.5 to 1.5% by weight. Nickel (Ni) is a solid solution hardened element and is a precipitation hardened element that forms an intermetallic compound with silicon (Si). When the nickel (Ni) content is smaller than 0.5%, it is difficult to secure strength. When the content exceeds 1.5%, it is difficult to increase conductivity.

(2) Cobalt (Co)

A content of cobalt (Co) is in a range of 0.3 to 1.5%. Cobalt (Co) forms a larger amount of fine intermetallic compounds compared to silicon (Si) and nickel (Ni), and has an excellent precipitation hardening effect. When the cobalt (Co) content is smaller than 0.3%, it is difficult to secure the strength of the obtained copper alloy. When the cobalt (Co) content exceeds 1.5%, a solution heat treatment temperature range is reduced, so that there is a possibility of forming a coarse intermetallic compound and significantly reducing the precipitation hardening effect.

(3) Silicon (Si)

A content of silicon (Si) is range of 0.35 to 0.8%. Silicon (Si) has a very large work hardening effect in the solid solution state. Further, silicon (Si) forms an intermetallic compound with nickel (Ni) and cobalt (Co), thus contributing to precipitation hardening. When the silicon (Si) content is smaller than 0.35%, a fraction of the intermetallic compound may be reduced, and thus an precipitation hardening effect may be insignificant. When the silicon (Si) content exceeds 0.8%, it is difficult to secure conductivity and Si forms an oxide film on a surface, thereby to reduce punchability.

(4) Chromium (Cr)

A content of chromium (Cr) is in range of 0.05 to 0.5%. Since chromium (Cr) may allow silicon and the intermetallic compound to be precipitated in a range below 980° C., fine intermetallic compounds may be formed in a grain boundary during hot rolling, thereby minimizing a grain size. This may prevent grain boundary cracks (see FIG. 2). Further, chromium (Cr) may contribute to precipitation hardening of intermetallic compounds especially when heat treatment is performed at 700° C. or lower. However, when the content of chromium (Cr) is smaller than 0.05%, the crack prevention effect may be exhibited during hot rolling, but the hardening effect may be significantly reduced. Thus, the purpose of the addition thereof is not achieved. To the contrary, when the content of chromium (Cr) exceeds 0.5%, Cr is not fully formed a solid solution in the copper (Cu) matrix in all temperature regions and thus a micrometer-sized coarse intermetallic compound may be formed. The coarse intermetallic compound thus formed may cause non-uniformity of a microstructure and thus deteriorate punchability and bending formability. Further, the coarse intermetallic compounds tend to absorb chromium (Cr), cobalt (Co), and nickel (Ni) and thus grow during precipitation heat treatment, thereby reducing formation of fine precipitates. This leads to decrease in the precipitation hardening effect.

In this regard, it may be identified referring to FIG. 2 which is a graph showing a phase fraction based a temperature in a composition (Example 1) according to the present disclosure, that a phase fraction of Cr—Si precipitates starts to increase at a temperature lower than 1000° C., that is, about 980° C., and Cr—Si precipitates is formed at about 0.002 mol at a temperature below 700° C.

(5) Sum of Contents of Nickel and Cobalt (Ni+Co)

Nickel (Ni) and cobalt (Co) are main elements that form the intermetallic compound with silicon (Si). 0.2% proof stress value tends to increase as the sum thereof increases. However, when the sum of the contents of nickel (Ni) and cobalt (Co) is smaller than 1.5%, it is difficult to satisfy target 0.2% proof stress. To the contrary, When the sum of the contents of nickel (Ni) and cobalt (Co) exceeds 2.6%, a temperature which complete solid solution heat treatment is performed must be increased to 1030° C. or higher, which is close to a melting point of copper. Thus, the elements may be molten during hot rolling. Therefore, the total amount (Ni+Co) of nickel and cobalt is preferably in a range of 1.5 to 2.6%.

(6) Ratio (Ni/Co) Between Contents of Nickel and Cobalt

In the copper alloy according to the present disclosure, a precipitation temperature range of the intermetallic compound may be controlled based on the ratio between the contents of nickel and cobalt (Ni/Co). The ratio between contents of nickel and cobalt (Ni/Co) is in a range of 0.8 to 1.3.

When the ratio between the contents of nickel and cobalt (Ni/Co) is smaller than 0.8, a precipitation rate becomes too fast and thus it is difficult to control a condition under which a target property is achieved. When the ratio between the contents of nickel and cobalt (Ni/Co) exceeds 1.3, precipitation of the intermetallic compound containing cobalt (Co) as a main component may not occur, so that it is difficult to secure conductivity of 55% IACS or higher.

(7) Relationship Between Contents of Nickel (Ni), Cobalt (Co), Silicon (Si) and Chromium (Cr)

In the copper alloy sheet material according to the present disclosure, a relationship between the contents of nickel (Ni), cobalt (Co), silicon (Si) and chromium (Cr) is as follows: $3.5 \leq (Ni+Co)/(Si-Cr/3) \leq 4.5$.

When a value of (Ni+Co)/(Si−Cr/3) is smaller than 3.5, the content of Si is too high, it is easy to obtain high strength, whereas conductivity is significantly reduced. Further, silicon oxide may be formed on a surface during casting, thereby to cause crack during hot rolling. When the value of (Ni+Co)/(Si−Cr/3) exceeds 4.5, it is difficult to secure conductivity of 50% IACS or higher.

(8) Other Elements

In one example, at least one of manganese (Mn), phosphorus (P), magnesium (Mg), tin (Sn), zinc (Zn), and zirconium (Zr) may be optionally added as optional other elements to the alloy as needed.

Manganese (Mn) may be contained in 0.01 to 0.2% content. Manganese (Mn) may have a solid solution hardening effect on the copper alloy. Further, when phosphorus (P) is added to the alloy, a fine Mn—P intermetallic compound may be formed in the grain boundary, thereby suppressing crack during hot rolling. However, this effect may not be expected when a content of Mn is smaller than 0.01%. When the content of Mn exceeds 0.2%, conductivity may be significantly lowered and coarse manganese oxide may be formed during casting, thereby to cause crack during casting.

When P is added to the content, the content of phosphorus (P) is in a range of 0.01 to 0.2%. When the appropriate amount of phosphorus (P) is added to the alloy, P may react with oxygen in a molten metal to form a fine oxide, thereby to achieve an effect of reducing a size of a cast texture. Further, P may lower an oxygen content in the copper alloy ingot, thereby to achieve an effect of suppressing hydrogen induced cracking. However, when the content of phosphorus (P) as added is smaller than 0.01%, it is difficult to expect such an effect. To the contrary, When the content of P exceeds 0.2%, the excessive P may rapidly lower the melting point of the alloy, thereby causing an eutectic reaction to form phosphide such as Co—P and Ni—P. This reduces the contents of cobalt (Co) and nickel (Ni) in the matrix, and suppresses precipitation hardening effect due to Co—Ni—Si intermetallic compound. Therefore, the content of phosphorus (P) is in a range of 0.01 to 0.2%.

When Mg is added to the alloy, a content of magnesium (Mg) is in a range of 0.01 to 0.2%. Magnesium (Mg) forms an intermetallic compound with silicon (Si), thereby to further improve the hardness and conductivity of the alloy. When the addition amount of Mg is smaller than 0.01%, this effect is insignificant. When the content of Mg exceeds 0.2%, there is a risk of lowering the bending formability. Therefore, the content of magnesium (Mg) is in a range of 0.01 to 0.2%.

When Sn is added to the alloy, the content of tin (Sn) is in a range of 0.01 to 0.2%. Tin (Sn) may be added as a solid solution hardening element. It is difficult to expect such an effect when the content of Sn is smaller than 0.01%. When the content of Sn exceeds 0.2%, it is difficult to secure conductivity of 55% IACS or higher.

When Zn is added to the alloy, the content of zinc (Zn) is in a range of 0.01 to 0.5%. Zinc (Zn) may act as a solid solution hardening element and increases corrosion resistance. When the content of Zn is smaller than 0.01%, there is little hardening effect. When the content thereof exceeds 0.5%, conductivity may be lowered.

When Zr is added to the alloy, the content of zirconium (Zr) is in a range of 0.01 to 0.1%. Zirconium (Zr) may not lower the conductivity and may have a similar effect to that of phosphorus (P). That is, Zr refines the cast texture and lower the oxygen content. When the content thereof is smaller than 0.01%, such an effect may be reduced. When the content of Zr exceeds 0.1%, Zr reacts with cobalt (Co) and nickel (Ni) to form a coarse intermetallic compound.

A sum of these other elements is up to 1.0%. When the sum of these other elements exceeds 1.0%, the strength or conductivity of the finally obtained copper alloy sheet material is significantly lowered, which is not preferable.

(8) Copper and Inevitable Impurities

The copper alloy sheet material according to the present disclosure contains a balance amount of copper (Cu) and inevitable impurities in addition to the above-described components. Inevitable impurities refer to lead (Pb), arsenic (Sb), carbon (C), and chlorine (Cl), which are inevitably contained in a raw material of the copper alloy sheet material or introduced during heat treatment and rolling. Since the content of the inevitable impurities is controlled to 0.05% or smaller, the effect thereof on the final obtained copper alloy sheet material is negligible.

Next, the method of producing the copper alloy sheet material according to the present disclosure is described with reference to FIG. 1.

First, the component elements are added and molten as components of the copper alloy sheet material of the present disclosure as described above. The molten metal is subjected to a cast process to form an ingot. In the melting step, raw materials may be heated at 1200 to 1300° C. so that the raw materials may be completely molten. When the melting temperature is too low, fluidity of the molten metal may deteriorate. To the contrary, when the melting temperature is too high, oxidation of highly oxidizable elements such as chromium (Cr) and cobalt (Co) occurs, thereby making it difficult to obtain a copper alloy with a desired composition. After the casting process, it is preferable to slowly cool the ingot at a rate of 20° C./s or lower over a temperature range of 700° C. or higher. This is because, when rapid cooling is performed immediately after the casting step, a volume variation may occur due to a difference between temperatures of a surface and an inner portion of the ingot, thereby to cause crack in the ingot.

Subsequently, the cast ingot is hot rolled at 950 to 1040° C. When hot rolling is performed at a temperature lower than 950° C., there is a possibility that the intermetallic compound precipitates in the grain boundary and thus cracks occur. When the hot rolling is performed at temperatures exceeding 1040° C., a final solidification point may be molten at the time of casting, thereby to cause red shortness.

Subsequently, the sheet material obtained via the hot-rolling is cooled. The cooling may be performed at a rate of 10 to 50° C./s to a temperature below 300° C. When the cooling rate after the hot rolling is smaller than 10° C./s, the intermetallic compound precipitates in a large amount and thus the solid solubility of the elements may be lowered in the solid solution heat treatment, so that the strength of the finally obtained copper alloy sheet material is reduced. When the cooling rate exceeds 50° C./s, intermetallic compounds are precipitated in a small amount, so that it is difficult to obtain a cube texture whose a crystal face of a rear face is mainly {200} during the solid solution heat treatment. Thus, bending formability may be deteriorated.

Subsequently, the copper alloy in a form of a cooled strip is cold rolled at a cold reduction rate of 70% or greater. When the cold reduction rate is lower than 70%, it is difficult to obtain desired properties in the solid solution heat treatment, which will be described later and it is difficult to ensure a target thickness of the final product.

Subsequently, the cold rolled sheet material is subjected to the solid solution heat treatment for 20 to 60 seconds at a temperature condition of 800 to 1040° C. When the solid solution heat treatment temperature is below 800° C., it is easy to secure conductivity during the precipitation heat treatment, while the strength tends to be low. When the solid solution heat treatment temperature exceeds 1040° C., the opposite trend may occur. That is, it is easy to secure strength, but tends to decrease conductivity. When solution heat treatment time is smaller than 20 seconds, the bending formability decreases because the cold rolled texture does not disappear completely. When the time is larger than 60 seconds, it is difficult to secure conductivity and strength due to the difficulty in forming precipitates due to grain coarsening.

The solid solution heat-treated sheet material is subjected to a thermal-mechanical double aging (TMDA) process. The TMDA process refers to a series of processes in which first precipitation heat treatment, cold rolling, and second precipitation heat treatment are performed, thereby to effectively achieve both of conductivity and 0.2% proof stress of the finally obtained copper alloy sheet material.

Since the TMDA process requires two precipitation heat treatment processes, the TMDA process has not been conventionally introduced in the copper alloy sheet material production process. This is because, in order to perform precipitation heat treatment of the copper alloy, it takes several hours to several days to operate a facility, so that performing the precipitation heat treatment twice or more is considerably disadvantageous in terms of cost and productivity. However, in accordance with the present disclosure, the first precipitation heat treatment is performed under control of a condition of the first precipitation heat treatment temperature together with the control of the contents of the alloy elements, while the first precipitation heat treatment time is set to a short time duration smaller than 60 seconds, so that price competitiveness and productivity may be secured. The complex controls of the content and process conditions have never been disclosed conventionally.

In the production method according to the present disclosure, in the first precipitation heat treatment of the TMDA process, heat treatment of the product obtained in the previous step is performed at 550 to 700° C. for 20 to 60 seconds. The intermetallic compound that precipitates during the first precipitation heat treatment does not precipitate in divided manner into Co—Si and Ni—Si but precipitates in Ni—Co—Si form in a mixed manner. Percentages of components of the compound may vary depending on a precipitation temperature range and the ratio of contents of Ni and Co (Ni/Co). This is identified via thermodynamic calculation of the molar fraction as disclosed in FIG. 3 and FIG. 4 as described below.

When the temperature and time of the first precipitation heat treatment are not sufficient, the formation of Ni—Co—Si precipitates mainly containing cobalt (Co) is insufficient during the first precipitation heat treatment process, so that it is difficult to secure the conductivity of the finished sheet material. To the contrary, when the temperature and time of the first precipitation heat treatment are too high and too long respectively, the amounts of the alloy elements in the matrix are small, and thus the strength increase amount during the cold rolling is significantly reduced and thus the precipitation of coarse precipitates may occur during the second precipitation heat treatment, such that the 0.2% proof stress of the finished sheet material is unlikely to exceed 720 MPa.

Subsequently, the first precipitation heat-treated sheet material is cold-rolled at a cold reduction rate of 10 to 50%. When the cold rolling is performed at a cold reduction rate smaller than 10%, it is difficult to expect an effective strength increase. When the cold rolling is carried out at a cold reduction rate above 50%, the 0.2% proof stress may exhibit a very good strength with 850 MPa or greater, but the bending formability is significantly reduced. Further, the second precipitation heat treatment time is too long. When the second precipitation heat treatment time is too long, there is a disadvantage that a cost required to operate the equipment increases and thus productivity decreases.

Subsequently, the cold rolled sheet material is subjected to the second precipitation heat treatment at 300 to 550° C. for 1 to 24 hours. In this connection, a temperature at which the maximum hardness is achieved may vary depending on the cold rolling cold reduction rate in the TMDA process. When the cold reduction rate is close to 50%, the second precipitation heat treatment should be close to 300° C. in order to achieve the maximum hardness. In this connection, the corresponding required heat treatment time is tens of hours. To the contrary, when the cold reduction rate is close to 10%, the second heat treatment should be performed at a relatively higher temperature while the second precipitation heat treatment time should be relatively short, for example, several hours. When conductivities of two sheet materials as obtained at different second precipitation treatment temperatures have similar levels, the 0.2% proof stress of the sheet material obtained under a lower second precipitation treatment temperature is relatively high. However, when the second precipitation heat treatment is performed under the above-described condition range, it is possible to achieve the balance between the strength and the conductivity required for a recent copper alloy sheet material.

Therefore, the sheet material having the desired physical properties may be obtained via the strict control of the process conditions of the first precipitation heat treatment, cold rolling and second precipitation heat treatment of the TMDA process as described above.

In relation to the TMDA process, FIG. 3 is a graph showing a molar fraction of each of elements of Ni—Co—Si precipitates based on the first and second precipitation heat treatment temperatures for the composition (Ni/Co=1.22) of Example 1. In this regard, the present inventors have identified based on thermodynamics experiment that a reference temperature around which a molar fraction changes is a temperature range of 550° C. to 700° C. depending on the Ni/Co ratio. As shown in FIG. 3, for the composition of Example 1, 630° C. is the reference temperature. In FIG. 3, when the precipitation temperature is higher than about 630° C., Ni—Co—Si precipitates mainly containing Co are formed. When the precipitation temperature is lower than about 630° C., the ratio between the contents of Co and Ni is reversed, such that Ni—Co—Si precipitates mainly containing Ni are formed. Therefore, it may be identified that it is preferable to perform the TDMA process at about 550° C. or lower in order to easily form Ni—Co—Si precipitates with the increased Ni molar fraction. That is, it may be seen that it is possible to simultaneously secure precipitates having different elemental composition ratios and thus contribute to the improvement of strength and conductivity. In accordance with the present disclosure, in order to achieve the purpose of the present disclosure via thermodynamic calculation and design, the first precipitation heat treatment is configured to performed in a temperature range in which precipitates mainly containing cobalt (Co) may be obtained from Ni—Co—Si precipitates. Then, the second precipitation heat treatment is configured to be carried out in a temperature range in which precipitates mainly containing nickel (Ni) may be obtained from Ni—Co—Si precipitates.

In one example, when the ratio (Ni/Co) between the contents of nickel and cobalt is out of the above range as defined according to the present disclosure, target properties of the copper alloy sheet material to be achieved in accordance with the present disclosure may not be achieved even when the precipitation heat treatment is performed according to the TMDA process conditions as suggested in accordance with the present disclosure. For example, FIG. 4 is a graph showing a molar fraction of each of elements of Ni—Co—Si precipitates based on first and second precipitation heat treatment temperatures for the composition of Comparative Example 8 (Ni/Co weight ratio 0.54). It may be identified based on FIG. 4 that Ni—Co—Si mainly containing cobalt (Co) is formed regardless of the precipitation heat treatment temperature. Therefore, in this case, even when the second precipitation heat treatment is performed, precipitation of Ni may not occur. Thus, Ni—Co—Si precipitates which mainly contains Co grow excessively, resulting in a sharp decrease in strength.

Further, when required, processes such as cold rolling, homogenizing heat treatment, softening heat treatment, surface cleaning (pickling and polishing), tensile annealing, and tension leveling may be selected and combined as carried out in a wrought copper factory.

Further, depending on the end use of the sheet material, processes such as plating, stamping, and etching may be added.

In one example, a microstructure of the copper alloy sheet material as produced according to the production method disclosed in the present disclosure contains an α mother phase and intermetallic compound particles. The intermetallic compound particles has an average diameter of 3 μm or smaller. When the average diameter of the intermetallic compound particles exceeds 3 μm, the particle acts as a concentration site of stress during bending, which may be a cause of cracking.

The copper alloy sheet material produced according to the present disclosure has 720 MPa to 820 MPa of the 0.2% proof stress as measured in a direction parallel to the rolling direction thereof, and has conductivity of 55% IACS to 60% IACS, and has a feature that a 90° bending formability in a direction parallel to the rolling direction and a direction perpendicular to the rolling is R/t=0. The characteristics of the strength, conductivity, and bending formability, as described above may not be achieved at the same time in the prior art and should be simultaneously achieved such that the copper alloy sheet material is used for parts of small electronic products used in the field of electrical and electronics today. The copper alloy sheet material having all of these characteristics may have an excellent effect, especially for an electronic component.

Specifically, the strength of the copper alloy sheet material produced according to the present disclosure is improved. For example, when the sheet material is used for a support in an electronic component module, the number of semiconductor chips that may be supported thereon may increase. Further, because the sheet material has excellent conductivity, the sheet material may be used for large-current transport parts. In addition, the copper alloy sheet material produced according to the present disclosure may be applied to electronic components such as switches and connectors that require excellent bending formability when designing components. In addition, the copper alloy sheet material produced according to the present disclosure may be applied to a USB terminal, a mobile SIM socket, etc., which require the above characteristics in combination thereof.

Subsequently, the present disclosure is described in more detail based on Examples. Examples are intended to help understand the present disclosure but are not intended to be limiting of the present disclosure.

EXAMPLES

Examples 1 to 10

The component elements based on the composition of Example 1 as shown in Table 1 below were molten and cast under an atmosphere to produce a copper alloy ingot, and then the ingot was heated in a heating furnace at 1000° C. for 1 hour and then is hot rolled to form a sheet material. The hot rolled copper alloy sheet material was subjected to cold rolling at a cold reduction rate of 98%, thereby to produce a 0.2 mm thick sheet material. Thus, solution heat treatment of the sheet material was performed at 950° C. for 30 seconds. Subsequently, the obtained product was water-quenched using a water bath at room temperature.

Thereafter, the product was subjected to the first precipitation heat treatment as the first step in the TMDA process at 640° C. for 30 seconds and then was water-cooled using a water bath at room temperature. Subsequently, the sheet material of a thickness having 0.15 mm was produced via cold rolling at a cold reduction rate of 25%. Finally, the second precipitation heat treatment was performed at 380° C. for 12 hours. The obtained copper alloy sheet material was cut into two pieces, each having a width of 60 mm and a length of 300 mm, which in turn were used as a specimen.

Specimens according to Examples 2 to 10 were produced in a similar manner to Example 1 based on the composition of the component elements in Table 1 and the process conditions in Table 2.

Comparative Examples 1 to 18

Specimens of Comparative Examples 1 to 18 were produced in a similar manner to Example 1 based on the composition of the component elements in Table 1 and the process conditions in Table 2.

TABLE 1

| Examples | Ni | Co | Si | Cr | Trace of element | Ni + Co | Ni/Co | (Ni + Co)/(Si − Cr/3) |
|---|---|---|---|---|---|---|---|---|
| Example 1 | 1.1 | 0.9 | 0.54 | 0.13 | — | 2 | 1.22 | 4.03 |
| Example 2 | 1.1 | 0.9 | 0.54 | 0.13 | — | 2 | 1.22 | 4.03 |
| Example 3 | 1.1 | 0.9 | 0.54 | 0.13 | — | 2 | 1.22 | 4.03 |
| Example 4 | 1.1 | 0.9 | 0.54 | 0.13 | — | 2 | 1.22 | 4.03 |
| Example 5 | 1.1 | 0.9 | 0.54 | 0.13 | 0.1Mn | 2 | 1.22 | 4.03 |
| Example 6 | 1.1 | 0.9 | 0.54 | 0.13 | 0.05P | 2 | 1.22 | 4.03 |
| Example 7 | 1.1 | 0.9 | 0.54 | 0.13 | 0.05Mg | 2 | 1.22 | 4.03 |
| Example 8 | 1.1 | 0.9 | 0.54 | 0.13 | 0.1Sn | 2 | 1.22 | 4.03 |
| Example 9 | 1.1 | 0.9 | 0.54 | 0.13 | 0.2Zn | 2 | 1.22 | 4.03 |
| Example 10 | 1.1 | 0.9 | 0.54 | 0.13 | 0.05Zr | 2 | 1.22 | 4.03 |
| Comparative Example 1 | 1.1 | 0.9 | 0.54 | 0.13 | — | 2 | 1.22 | 4.03 |
| Comparative Example 2 | 1.1 | 0.9 | 0.54 | 0.13 | — | 2 | 1.22 | 4.03 |
| Comparative Example 3 | 1.1 | 0.9 | 0.54 | 0.13 | — | 2 | 1.22 | 4.03 |
| Comparative Example 4 | 1.1 | 0.9 | 0.54 | 0.13 | — | 2 | 1.22 | 4.03 |
| Comparative Example 5 | 1.1 | 0.9 | 0.45 | 0.13 | — | 2 | 1.22 | 4.92 |
| Comparative Example 6 | 1.1 | 0.9 | 0.54 | 0.3 | — | 2 | 1.22 | 4.55 |
| Comparative Example 7 | 1.1 | 0.9 | 0.7 | 0.13 | — | 2 | 1.22 | 3.04 |
| Comparative Example 8 | 0.7 | 1.3 | 0.54 | 0.13 | — | 2 | 0.54 | 4.03 |
| Comparative Example 9 | 0.7 | 0.6 | 0.38 | 0.13 | — | 1.3 | 1 .17 | 3.86 |
| Comparative Example 10 | 1.4 | 0.7 | 0.6 | 0.13 | — | 2.1 | 2.00 | 3.77 |
| Comparative Example 11 | 1.1 | 0.9 | 0.54 | 0.13 | 0.6Mn | 2 | 1.2.2 | 4.03 |
| Comparative Example 12 | 1.1 | 0.9 | 0.54 | 0.13 | 0.5P | 2 | 1.22 | 4.03 |
| Comparative Example 13 | 1.1 | 0.9 | 0.54 | 0.13 | 0.6Mg | 2 | 1.22 | 4.03 |
| Comparative Example 14 | 1.1 | 0.9 | 0.54 | 0.13 | 0.6Sn | 2 | 1.22 | 4.03 |
| Comparative Example 15 | 1.1 | 0.9 | 0.54 | 0.13 | 0.6Zn | 2 | 1.22 | 4.03 |
| Comparative Example 16 | 1.1 | 0.9 | 0.54 | 0.13 | 0.5Zr | 2 | 1.22 | 4.03 |
| Comparative Example 17 | 1.1 | 0.9 | 0.7 | 0.6 | — | 2 | 1.22 | 4 |
| Comparative Example 18 | 1.1 | 0.9 | 0.5 | — | — | 2 | 1.22 | 44 |

TABLE 2

| Examples | Hot rolling temperature (° C.* 1 h) | Cold rolling cold reduction rate (%) | Solution heat treatment (° C., s) | Thermal-mechanical double aging (TMDA) First precipitation temperature (° C.*1 min) | Cold reduction rate (%) | Second precipitation temperature (° C., h) |
|---|---|---|---|---|---|---|
| Example 1 | 1000 | 98 | 950, 30 | 640 | 25 | 380, 12 |
| Example 2 | 1000 | 98 | 950, 30 | 640 | 25 | 380, 15 |
| Example 3 | 1000 | 98 | 950, 30 | 640 | 25 | 380, 18 |
| Example 4 | 1000 | 98 | 950, 30 | 640 | 25 | 380, 24 |
| Example 5 | 1000 | 98 | 950, 30 | 640 | 25 | 380, 15 |
| Example 6 | 1000 | 98 | 950, 30 | 640 | 25 | 380, 15 |
| Example 7 | 1000 | 98 | 950, 30 | 640 | 25 | 380, 12 |
| Example 8 | 1000 | 98 | 950, 30 | 640 | 25 | 380, 15 |
| Example 9 | 1000 | 98 | 950, 30 | 640 | 25 | 380, 15 |
| Example 10 | 1000 | 98 | 950, 30 | 640 | 25 | 380, 18 |
| Comparative Example 1 | 850 | Not performed due to crack occurring in hot rolling | | | | |
| Comparative Example 2 | 1000 | 98 | 750, 50 | 640 | 25 | 380, 12 |
| Comparative Example 3 | 1000 | 98 | 950, 30 | 800 | 25 | 380, 12 |
| Comparative Example 4 | 1000 | 98 | 950, 30 | 640 | Not performed | 380, 12 |
| Comparative Example 5 | 1000 | 98 | 950, 30 | 640 | 25 | 380, 12 |
| Comparative Example 6 | 1000 | 98 | 950, 30 | 640 | 25 | 380, 12 |
| Comparative Example 7 | 1000 | 98 | 950, 30 | 640 | 25 | 380, 12 |
| Comparative Example 8 | 1000 | 98 | 950, 30 | 640 | 25 | 380, 12 |
| Comparative Example 9 | 1000 | 98 | 950, 30 | 640 | 25 | 380, 12 |
| Comparative Example 10 | 1000 | 98 | 950, 30 | 640 | 25 | 380, 12 |
| Comparative Example 11 | 1000 | 98 | 950, 30 | 640 | 25 | 380, 12 |
| Comparative Example 12 | 1000 | 98 | 950, 30 | 640 | 25 | 380, 12 |
| Comparative Example 13 | 1000 | 98 | 950, 30 | 640 | 25 | 380, 12 |
| Comparative Example 14 | 1000 | 98 | 950, 30 | 640 | 25 | 380, 12 |
| Comparative Example 15 | 1000 | 98 | 950, 30 | 640 | 25 | 380, 12 |
| Comparative Example 16 | 1000 | 98 | 950, 30 | 640 | 25 | 380, 12 |
| Comparative Example 17 | 1000 | 98 | 950, 30 | 640 | 25 | 380, 12 |
| Comparative Example 18 | 1000 | 98 | 950, 30 | 640 | 25 | 380, 12 |

EXPERIMENTAL EXAMPLES

The characteristics of the specimens of the copper alloy sheet materials produced according to Examples and Comparative Examples were evaluated.

To evaluate the strength, the specimen was reworked according to a tensile test (ISO 6892) and then a test was performed.

Further, in order to investigate the conductivity, the conductivity of the specimen was measured using a conductivity meter (Sigmatest 2.069) from Forester corporation.

Further, to measure a size of intermetallic compound particles, a microstructure was observed using a scanning electron microscope from JEOL corporation. When a particle having an average diameter larger than 3 μm was found, O was marked, while when not, X was marked.

In a bending formability test (JIS H 3130), a W bending test was performed in which a bending axis is the same direction (bad way) as a rolling direction. When a ratio of a radius (R) of a bent portion to a thickness (t) thereof is 0 (that is, 90° R/t=0), crack does not occur. In this case, O was marked. When a crack occurs, X was marked.

The measurement results of the characteristic evaluation are shown in Table 3 below.

TABLE 3

| Examples | Properties of finished sheet material: Conductivity (% IACS) | 0.2% proof stress (MPa) | Bending formability (90° R/t = 0) | Microstructure: Presence or absence of precipitate larger than 3 μm |
|---|---|---|---|---|
| Example 1 | 55.1 | 812 | ○ | X |
| Example 2 | 55.9 | 793 | ○ | X |
| Example 3 | 57.2 | 772 | ○ | X |
| Example 4 | 58.3 | 735 | ○ | X |
| Example 5 | 55.3 | 822 | ○ | X |
| Example 6 | 56.5 | 809 | ○ | X |
| Example 7 | 56 | 803 | ○ | X |
| Example 8 | 55 | 815 | ○ | X |

TABLE 3-continued

| Examples | Properties of finished sheet material | | | Microstructure |
|---|---|---|---|---|
| | Conductivity (% IACS) | 0.2% proof stress (MPa) | Bending formability (90° R/t = 0) | Presence or absence of precipitate larger than 3 μm |
| Example 9 | 55.2 | 811 | ○ | X |
| Example 10 | 57.6 | 783 | ○ | X |
| Comparative Example 1 | Not performed due to crack occurring in hot rolling | | | |
| Comparative Example 2 | 56.2 | 704 | ○ | X |
| Comparative Example 3 | 52 | 793 | ○ | X |
| Comparative Example 4 | 52 | 786 | ○ | X |
| Comparative Example 5 | 49 | 820 | ○ | X |
| Comparative Example 6 | 56 | 719 | X | ○ |
| Comparative Example 7 | 46 | 845 | ○ | X |
| Comparative Example 8 | 59.5 | 702 | ○ | X |
| Comparative Example 9 | 60.1 | 675 | ○ | X |
| Comparative Example 10 | 47.6 | 848 | X | X |
| Comparative Example 11 | 47.2 | 855 | ○ | X |
| Comparative Example 12 | 59 | 704 | X | ○ |
| Comparative Example 13 | 49 | 852 | X | X |
| Comparative Example 14 | 45 | 860 | X | X |
| Comparative Example 15 | 52 | 805 | ○ | X |
| Comparative Example 16 | 58 | 709 | X | ○ |
| Comparative Example 17 | 51 | 762 | X | ○ |
| Comparative Example 18 | 59.3 | 651 | ○ | X |

As shown in Table 3, in the copper alloy sheet materials obtained according to Examples 1 to 10, a size of the intermetallic compound does not exceed 3 μm, conductivity is larger than 55% IACS, and 0.2% proof stress is larger than 720 MPa. Further, the 90° bending formability has R/t=0, thus, the sheet materials may be used for an electronic component having a bent portion such as a connector.

However, in Comparative Example 1, the hot rolling temperature was remarkably low, and thus side cracks were induced along the grain boundary. Thus, the process after the hot rolling could not be performed.

In Comparative Example 2, the solid solution heat treatment temperature is low and is 750° C., a large amount of fine intermetallic compound particles may be formed during precipitation heat treatment due to a small amount of supersaturated Co and Ni atoms. Thus, 0.2% proof stress 720 MPa may not be secured.

In Comparative Example 3, the first precipitation heat treatment temperature in the thermal-mechanical double aging process was a relatively low temperature of 500° C. As a result, the conductivity was found to be 55% IACS or lower. This is because the precipitation heat treatment was not performed in the temperature range where precipitation of Co may occur.

In Comparative Example 4, the cold rolling between the first and second precipitation heat treatments did not occur. After the second precipitation heat treatment, the finishing cold rolling was performed at a 25% cold reduction rate. As a result, both of the conductivity 55% IASC, and 0.2% proof stress 720 MPa were not obtained at the same time. This is because after the second precipitation heat treatment, the number of solid solution formed atoms on the matrix was significantly reduced, such that work hardening via the cold rolling was not effective.

In Comparative Example 5 and Comparative Example 6, the (Ni+Co)/(Si−Cr/3) value exceeded the range suggested in accordance with the present disclosure. Therefore, an effective intermetallic compound formation did not occur, and, thus, Ni and Co are present as the remainders in the matrix, thereby not to secure the target conductivity.

In Comparative Example 7, the (Ni+Co)/(Si−Cr/3) value was 3.04 which was smaller than the range suggested in accordance with the present disclosure. As a result, Si that failed to combine with Ni and Co to form Ni—Co—Si remains as the remainder, thereby lowering conductivity.

In Comparative Example 8, the Ni/Co ratio was smaller than the range suggested in the present disclosure. Therefore, a precipitation rate of the Ni—Co—Si intermetallic compound containing a large amount of Co becomes too high. Thus, the conductivity may be secured. However, it is difficult to refine the precipitates, such that the strength is rapidly reduced.

In Comparative Example 9, the sum of Ni and Co contents was smaller than the range suggested in the present disclosure. Therefore, coarse intermetallic compounds were not formed and thus conductivity is relatively high. However, a large amount of fine intermetallic compounds was not formed, thereby not to satisfy 0.2% proof stress 720 MPa.

In Comparative Example 10, the Ni/Co ratio exceeded the range suggested in the present disclosure. When the content of Ni increases, the precipitation temperature at which the Ni—Co—Si compound having a high Co content is formed increases, thereby making Co precipitation via the first precipitation heat treatment difficult. Therefore, the conductivity was lowered.

In Comparative Example 11 to Comparative Example 16, the content of each of the component elements exceeds a range defined according to the present disclosure, resulting in poor conductivity, or resulting in reduced bending formability due to formation of coarse intermetallic compounds.

In Comparative Example 17, the alloy has the Cr content exceeding the range defined according to the present disclosure. Thus, the conductivity decreases, and the bending formability is lowered.

In Comparative Example 18, Cr as an essential element suggested in the present disclosure was added to the alloy. Thus, it is easy to secure the conductivity due to increase in a purity of the matrix. However, 0.2% proof stress 720 MPa is not realized.

What is claimed is:

1. A method of producing a copper alloy sheet material, wherein the copper alloy sheet material contains the following component elements:

nickel (Ni) 0.5 to 1.5% by weight;

cobalt (Co) 0.3 to 1.5% by weight;

silicon (Si) 0.35 to 0.8% by weight;

chromium (Cr) 0.05 to 0.5% by weight;

a balance amount of copper (Cu); and inevitable impurities, wherein the method comprises:

melting and casting the above component elements to form an ingot;

hot-rolling the ingot at 950 to 1040° C.;

cooling the hot-rolled product;

cold-rolling the cooled product at a cold reduction rate of 70% or higher to form a copper alloy sheet material;

performing solid solution heat treatment of the sheet material at 800 to 1040° C. for 20 to 60 seconds; and performing thermal-mechanical double aging of the solid solution heat treated sheet material, wherein the thermal-mechanical double aging includes:

performing first precipitation of the solid solution heat treated sheet material at 550 to 700° C. for 20 to 60 seconds;

cold-rolling the first precipitated sheet material at a cold reduction rate of 10 to 50%; and performing second precipitation of the cold rolled sheet material at 300 to 550° C. for 1 to 24 hours.

2. The method of claim 1, wherein a sum of contents of nickel (Ni) and cobalt (Co) meets a following relationship: $1.5 \leq Ni+Co \leq 2.6$, and wherein a ratio between contents of nickel (Ni) and cobalt (Co) satisfies a following relationship: $0.8 \leq Ni/Co \leq 1.3$.

3. The method of claim 1, wherein contents of nickel (Ni), cobalt (Co), silicon (Si) and chromium (Cr) satisfies a following relationship: $3.5 \leq (Ni+Co)/(Si-Cr/3) \leq 4.5$.

4. The method of claim 1, wherein the copper alloy sheet material further contains at least one selected from a group consisting of manganese (Mn) 0.01 to 0.2% by weight, phosphorus (P) 0.01 to 0.2% by weight, magnesium (Mg) 0.01 to 0.2% by weight, tin (Sn) 0.01 to 0.2% by weight, zinc (Zn) 0.01 to 0.5% by weight, and zirconium (Zr) 0.01 to 0.1% by weight.

5. The method of claim 1, wherein the copper alloy sheet material has a microstructure containing an α mother phase and intermetallic compound precipitates, wherein the intermetallic compound precipitates have an average diameter of 3 μm or smaller.

6. The method of claim 5, wherein 0.2% proof stress of the copper alloy sheet material measured in a direction parallel to a rolling direction thereof is in a range of 720 MPa to 820 MPa, wherein conductivity of the copper alloy sheet material is in a range of 55% IACS to 60% IACS, wherein a 90° bending formability in a direction parallel to a rolling direction and a direction perpendicular to a rolling direction of the copper alloy sheet material is R/t=0.

7. The method of claim 2, wherein the copper alloy sheet material has a microstructure containing an α mother phase and intermetallic compound precipitates, wherein the intermetallic compound precipitates have an average diameter of 3 μm or smaller.

8. The method of claim 3, wherein the copper alloy sheet material has a microstructure containing an α mother phase and intermetallic compound precipitates, wherein the intermetallic compound precipitates have an average diameter of 3 μm or smaller.

9. The method of claim 4, wherein the copper alloy sheet material has a microstructure containing an α mother phase and intermetallic compound precipitates, wherein the intermetallic compound precipitates have an average diameter of 3 μm or smaller.

* * * * *